US005372528A

United States Patent [19]

Nakamura et al.

[11] Patent Number: 5,372,528

[45] Date of Patent: Dec. 13, 1994

[54] TILTING AND TRIMMING MECHANISM FOR OUTBOARD ENGINE

[75] Inventors: Tamotu Nakamura; Shigeru Kai, both of Saitama, Japan

[73] Assignee: Kabushiki Kaisha Showa Seisakusho, Saitama, Japan

[21] Appl. No.: 962,332

[22] Filed: Oct. 16, 1992

[30] Foreign Application Priority Data

Oct. 17, 1991 [JP] Japan ..... 3-298428
Nov. 17, 1991 [JP] Japan ..... 3-319772

[51] Int. Cl.[5] ..... B63H 21/26
[52] U.S. Cl. ..... 440/61
[58] Field of Search ..... 440/61, 53, 84

[56] References Cited

U.S. PATENT DOCUMENTS

| | | | |
|---|---|---|---|
| 4,064,824 | 12/1977 | Hall et al. | 440/61 |
| 4,096,820 | 6/1978 | Hall et al. | 440/61 |
| 4,363,629 | 12/1982 | Hall et al. | 440/61 |
| 4,391,592 | 7/1983 | Hundertmark | 440/61 |
| 4,395,239 | 7/1983 | Hall et al. | 440/61 |
| 4,490,120 | 12/1984 | Hundertmark | 440/61 |
| 4,498,871 | 2/1985 | Hall et al. | 440/61 |
| 4,687,449 | 8/1987 | Fenrich | 440/61 |
| 4,702,714 | 10/1987 | Nakase | 440/61 |
| 5,067,919 | 11/1991 | Okita | 440/61 |
| 5,176,093 | 1/1993 | Binversie et al. | 440/61 |

FOREIGN PATENT DOCUMENTS

| | | |
|---|---|---|
| 59-124497 | 7/1984 | Japan . |
| 60-18497 | 1/1985 | Japan . |
| 60-53494 | 3/1985 | Japan . |
| 60-104492 | 8/1985 | Japan . |
| 60-229894 | 11/1985 | Japan . |
| 60-234096 | 11/1985 | Japan . |
| 1-282087 | 11/1989 | Japan . |

*Primary Examiner*—Stephen P. Avila
*Attorney, Agent, or Firm*—Howard L. Rose

[57] ABSTRACT

Tilt and trim cylinders have blind-end chambers connected through a main valve to a first port of a reversible pump. The rod-end chamber of the tilt cylinder is connected through the main valve to a second port of the reversible pump. The rod-end chamber of the trim cylinder is connected to an oil tank. The second port of the pump is connected to the oil tank, and the first port may be connected to either only the main valve or the oil tank through a suction-prevention valve, an orifice, or a pressure relief valve. When the pump is actuated with the tilt cylinder locked to keep an outboard engine in an tilted-up position, the trim cylinder is automatically contracted to withdraw its piston rod. Cavitation in an oil passage from the blind-end chamber of the trim cylinder to the pump is prevented when working oil is introduced from the oil tank to the pump through the orifice or the pressure relief valve.

9 Claims, 8 Drawing Sheets

TILTING AND TRIMMING MECHANISM FOR OUTBOARD ENGINE

BACKGROUND OF THE INVENTION

1. Field of the Invention

The present invention relates to a mechanism for tilting and trimming an outboard engine mounted on a boat.

2. Description of the Prior Art

Small-size shims such as motorboats with outboard engines have a tilting and trimming device including a tilt cylinder for tilting the outboard engine upwardly out of and downwardly into the water, and trim cylinders for changing the angle of the outboard engine underwater. The tilt and trim cylinders are hydraulically operated under the pressure of working oil supplied from a pump.

The tilting and trimming device is capable of tilting down the outboard engine from a tilted-up position upwardly of the water. When the outboard engine is to be tilted down, if the trim cylinders were brought down prior to the tilt cylinder, the outboard engine would not contact the trim cylinders in a position where it should, and could not be adjusted in angle underwater. To avoid such a drawback, there has been proposed a tilting and trimming mechanism for preventing trim cylinders from moving downwardly prior to a tilt cylinder, as shown in FIGS. 7 and 8 of the accompanying drawings.

The proposed tilting and trimming mechanism operates to move the outboard engine upwardly as follows: As shown in FIG. 7, a pump 100 is rotated in one direction by a motor to discharge working oil from a port 100*a* to a lefthand pressure chamber 101*a* of a main valve 101. The oil pressure applied to the lefthand pressure chamber 101*a* opens a check valve 102, and also moves a spool 103 in the main valve 101 to the right, opening a check valve 104. The working oil supplied to the lefthand pressure chamber 101*a* is delivered through the check valve 102 and an oil passage 105 to a lower chamber 106*a* of a tilt cylinder 106 and also to lower chambers 107*a* of respective trim cylinders 107. Piston rods 106*c*, 107*c* of the tilt and trim cylinders 106, 107 are therefore pushed upwardly. Working oil in an upper chamber 106*b* of the tilt cylinder 106 is delivered through an oil passage 108, the check valve 104, and a righthand pressure chamber 101*b* of the main valve 101 into a port 100*b* of the pump 100. Working oil in upper chambers 107*b* of the respective trim cylinders 107 are drained into an oil tank 110 through an oil passage 109. At the same time, working oil is drawn from a tank 110 through an oil passage 111 into the pump 100 to make up for an oil shortage that is caused by the portions of the piston rods 106*c*, 107*c* which are displaced out of the tilt and trim cylinders 106, 107.

The tilting and trimming mechanism operates to move the outboard engine downwardly as follows: As shown in FIG. 8, the pump 100 is reversed, i.e., rotated in the opposite direction, to supply working oil from the tank 110 through an oil passage 112 to the righthand pressure chamber 101*b* of the main valve 101. The oil pressure applied to the righthand pressure chamber 101*b* opens the check valve 104, and also moves the spool 103 in the main valve 101 to the left, opening the check valve 102. When the pump 100 is continuously reversed, the working oil is delivered through the check valve 104 and the oil passage 108 to the upper chamber 106*b* of the tilt cylinder 106, whereupon the piston rod 106*c* is lowered.

At this time, the upper chambers 107*b* of the trim cylinders 107 are not supplied with working oil, and the working oil is not drawn out of the lower chambers 107*a* of the trim cylinders 107 as the pressure in the oil passage 105 produced with the working oil drawn out of the lower chamber 106*a* of the tile cylinder 106 exceedingly acts in the lower chambers 107*a*. Accordingly, only the working oil from the lower chamber 106*a* of the tilt cylinder 106 is supplied through the main valve 101 and the pump 100 to the upper chamber 106*b*, lowering the piston rod 106*c*.

As a result, the trim cylinders 107 are prevented from moving downwardly prior to the tilt cylinder 106. When the tilt cylinder 106 is contracted to a predetermined position, the piston rods 107*c* of the trim cylinders 107 come into engagement with portions 113 of the outboard engine. Subsequently, the piston rods 107*c* are lowered by the portions 103 of the outboard engine, forcing the working oil to flow from the lower chambers 107*a* through the oil passage 105 and the check valve 102 to the pump 100. The upper chambers 107*b* draw working oil from the tank 110 through the oil passage 109. Any excess working oil flowing from the tilt and trim cylinders 106, 107 returns to the tank 110 through a down-blow valve 116.

While the outboard engine is being kept in the tilted-up position for a long period of time as when the motorboat is moored, if the piston rods 107*c* remained projected out, shellfishes would tend to attach to and rust would tend to develop on the piston rods 107*c*. According to the customary practice, when the outboard engine is to be kept in the tilted-up position, the outboard engine is locked against downward movement by a suitable lock, and a manual valve 114 is opened and the piston rods 107*c* are manually pushed into the trim cylinder 107.

As described above, the conventional tilting and trimming mechanism is effective to prevent the trim cylinders 107 from moving downwardly prior to the tilt cylinder 106. However, it is tedious and time-consuming to manually lower the piston rods 107*c* as when the motorboat is moored.

SUMMARY OF THE INVENTION

It is an object of the present invention to provide a mechanism for tilting and trimming an outboard engine mounted on a boat, which mechanism is capable of automatically retracting piston rods of trim cylinders when the outboard engine is locked in a tilted-up position.

According to the present invention, there is provided a mechanism for hydraulically tilting and trimming an outboard engine mounted on a boat, comprising an oil tank, a reversible pump having a pair of first and second ports, a tilt cylinder adapted to be coupled to the outboard engine, the tilt cylinder having a rod-end chamber and a blind-end chamber, a trim cylinder adapted to engage the outboard engine, the trim cylinder having a rod-end chamber and a blind-end chamber, and a main valve, the blind-end chambers of the tilt and trim cylinders being connected through the main valve to the first port of the reversible pump, the rod-end chamber of the tilt cylinder being connected through the main valve to the second port of the reversible pump, the rod-end chamber of the trim cylinder being connected to the oil tank, the second port being connected to the oil tank, the first port being connected to only the main valve.

According to the present invention, there is also provided a mechanism for hydraulically tilting and trimming an outboard engine mounted on a boat, comprising an oil tank, a reversible pump having a pair of first and second ports, a tilt cylinder adapted to be coupled to the outboard engine, the tilt cylinder having a rod-end chamber and a blind-end chamber, a trim cylinder adapted to engage the outboard engine, the trim cylinder having a rod-end chamber and a blind-end chamber, and a main valve, the blind-end chambers of the tilt and trim cylinders being connected through the main valve to the first port of the reversible pump, the rod-end chamber of the tilt cylinder being connected through the main valve to the second port of the reversible pump, the rod-end chamber of the trim cylinder being connected to the oil tank, the second port being connected to the oil tank, the first port being connected to the oil tank through a pressure restricting mechanism.

The pressure restricting mechanism may comprise a suction-prevention valve, an orifice, or a pressure relief valve.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
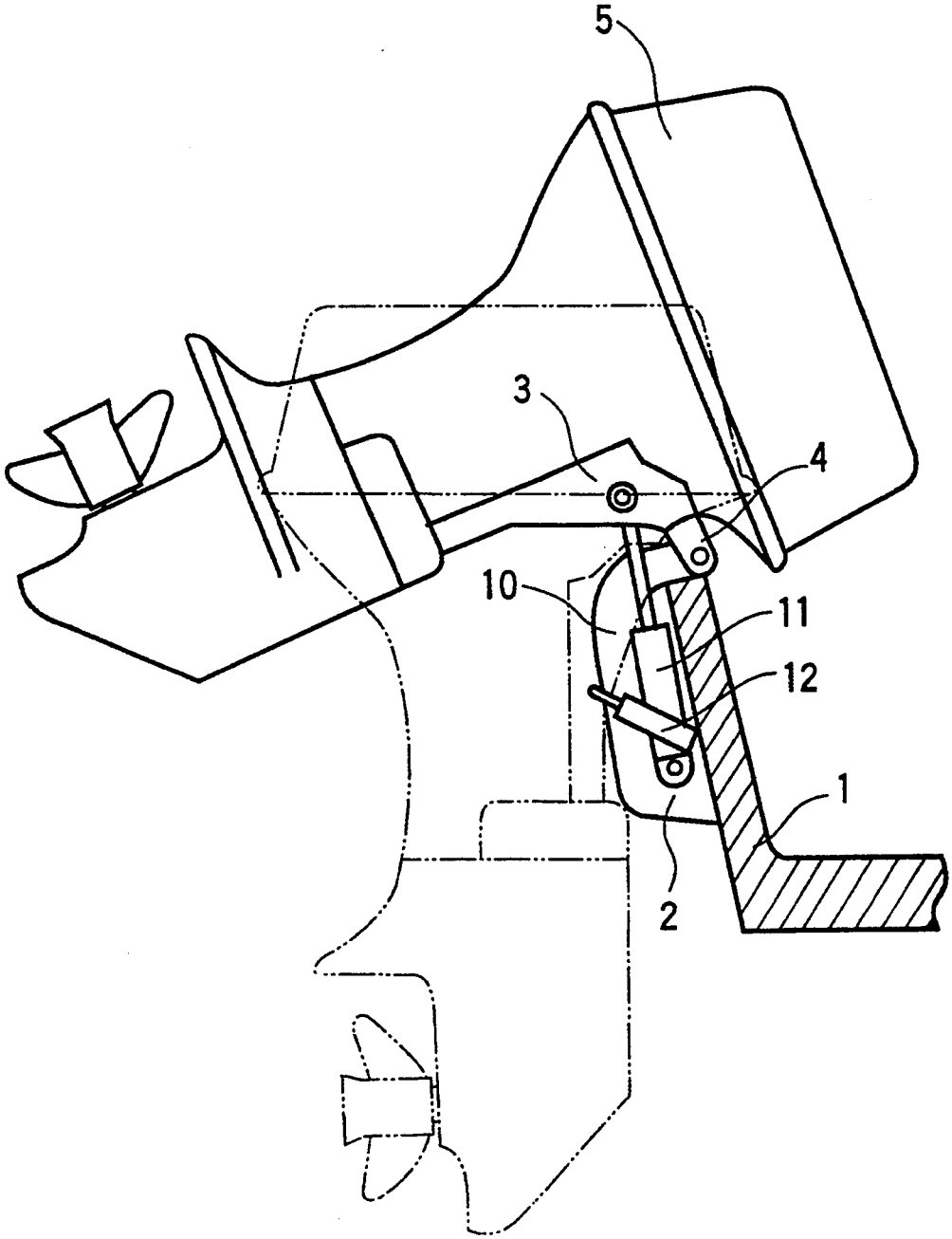
FIG. 1 is a side elevational view, partly in cross sect ion, or an outboard engine mounted on the stern of a motorboat, with a tilting and trimming mechanism according to the present invention being coupled between the outboard engine and the stern.

Like or corresponding parts are denoted by like or corresponding reference numerals throughout views.

As shown in FIG. 1, a pair of horizontally spaced stern brackets 2 (only one shown) is fixed to the outer rear surface of the stern of a small motorboat. A swivel bracket 3 is vertically angularly movably supported between the stern brackets 2 by a shaft 4. An outboard engine 5 is attached to the swivel bracket 3 for vertical angular movement about the shaft 4.

A tilting and trimming mechanism 10 according to the present invention is disposed between the stern brackets 2. The tilting and trimming mechanism 10 has a tilt cylinder 11 for tilting the outboard engine 5 upwardly and downwardly about the shalt 4, and a pair of trim cylinders 12, one on each side of the tilt cylinder 11, for varying the angle of the outboard engine 5 with respect to the longitudinal axis of the motorboat.

Figure 2:
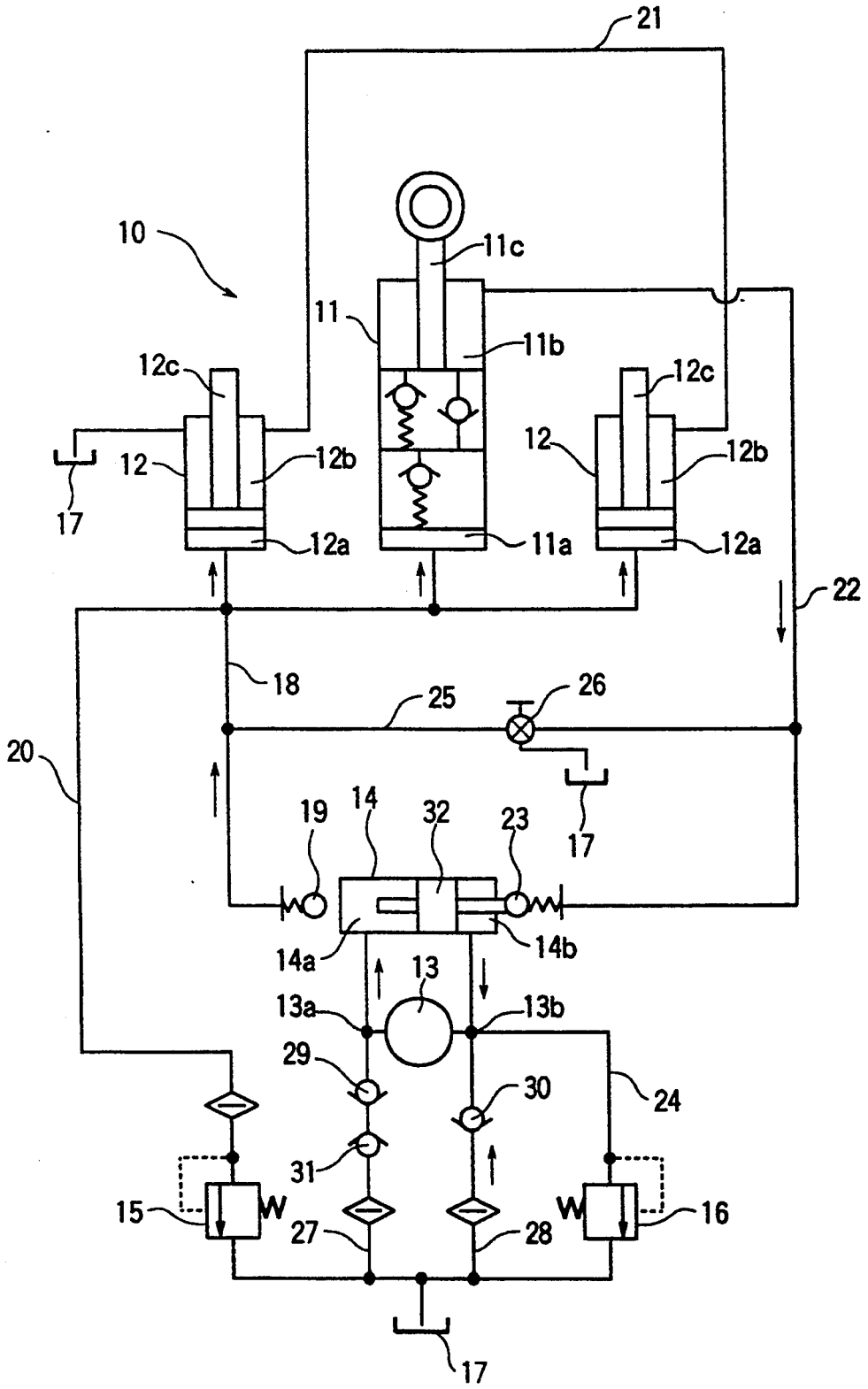
FIG. 2 is a circuit diagram of a hydraulic circuit arrangement of the tilting and trimming mechanism, showing parts positions when it tilts the outboard engine upwardly.
Figure 3:
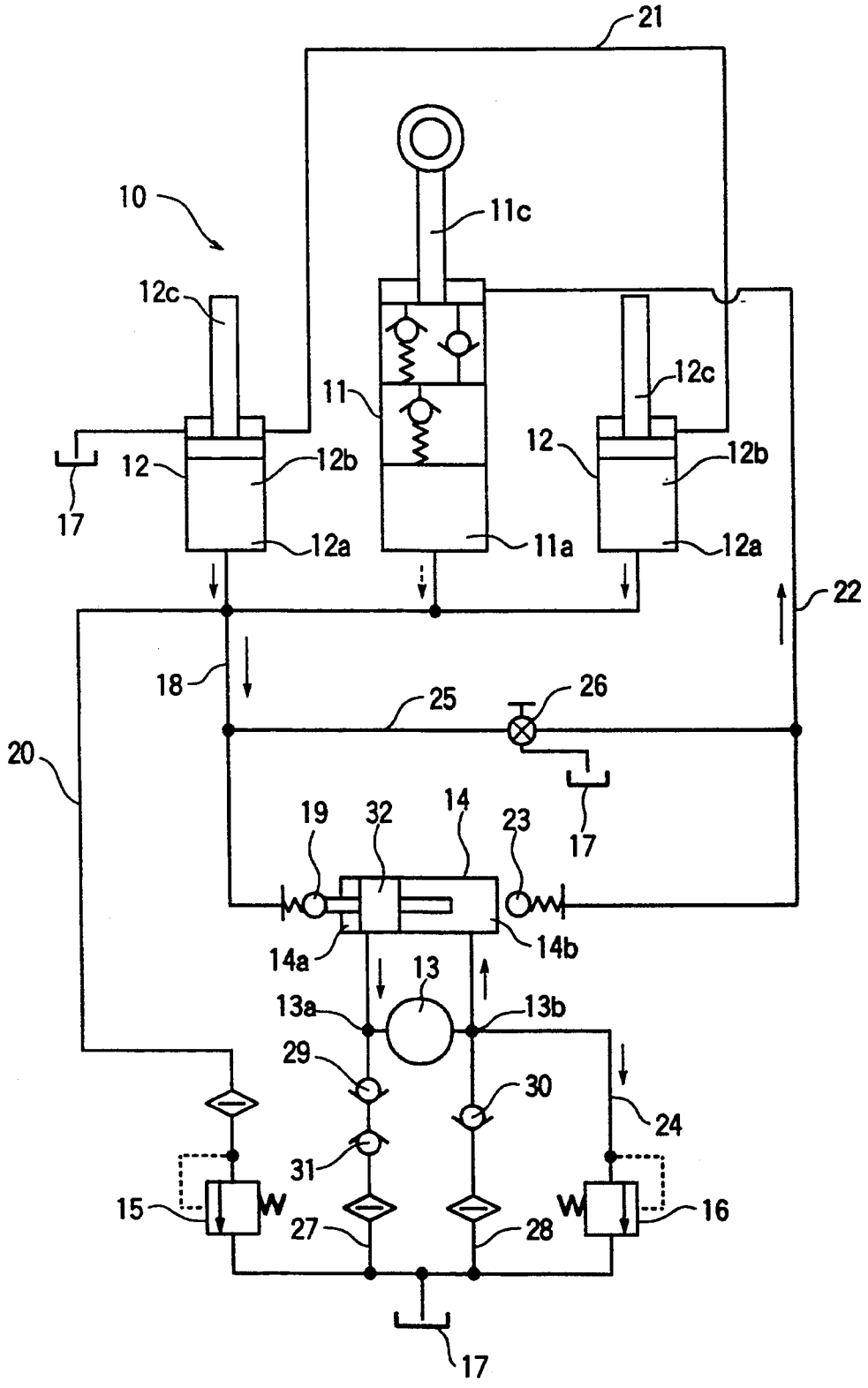
FIG. 3 is a circuit diagram of a hydraulic circuit arrangement of the tilting and trimming mechanism, showing parts positions when it tilts the outboard engine downwardly.

The tilting and trimming mechanism 10 has a hydraulic circuit arrangement, including the tilt and trim cylinders 11, 12, as shown in FIGS. 2 and 3. In FIGS. 2 and 3, the tilting and trimming mechanism 10 includes a reversible pump 13 actuated by a motor, a main valve 14, an up-blow valve 15, a down-blow valve 16, and an oil tank 17.

The tilt cylinder 11 has a lower, or blind-end, chamber 11*a* and an upper, or rod-end, chamber 11*b* which are divided by a piston having an upwardly extending piston rod 11*c*. Each of the trim cylinders 12 has a lower, or blind-end, chamber 12*a* and an upper, or rod-end, chamber 12*b* which are divided by a piston having an upwardly extending piston rod 12*c*. The main valve 14 has lefthand and righthand pressure chambers 14*a*, 14*b* with a slidable spool 32 disposed therebetween. The slidable spool 32 can selectively open check valves 19, 23 connected to the main valve 14.

The lower chambers 11*a*, 12*a* of the tilt and trim cylinders 11, 12 are connected through an oil passage 18, the check valve 19, and the lefthand pressure chamber 14*a* to a port 13*a* of the pump 13. The up-blow valve 15 is connected to the tank 17 and also to an oil passage 20 branched from the oil passage 18.

The upper chambers 12*b* of the trim cylinders 12 are connected through an oil passage 21 to the tank 17. The upper chamber 11*b* of the tilt cylinder 11 is connected through an oil passage 22, the check valve 23, and the righthand pressure chamber 14*b* to a port 13*b* of the pump 13. The down-blow valve 16 is connected to an oil passage 24 extending from the port 13*b*, and also to the tank 17.

A manual valve 26 connected to the tank 17 is coupled to an oil passage 25 which is connected to the oil passages 18, 22.

Oil passages 27, 28 extend from the tank 17 to the ports 13*a*, 13*b*, respectively, of the pump 13 through respective check valves 29, 30. The oil passage 27 has a suction-prevention valve 51 positioned between the check valve 29 and the tank 17. The suction-prevention valve 31 prevents an oil flow therethrough from the tank 17 to the pump 13 under a negative pressure developed in the oil passage 18.

Operation of the tilting and trimming mechanism to tilt the outboard engine 5 upwardly will be described below with reference to FIG. 2. The pump 13 is rotated in one direction by the motor to discharge working oil from the port 13*a* to the lefthand pressure chamber 14*a* of the main valve 14. The oil pressure applied to the lefthand pressure chamber 14*a* opens the check valve 19, and also moves the spool 22 in the main valve 14 to the right, opening the check valve 23. The working oil supplied to the lefthand pressure chamber 14*a* is delivered through the check valve 19 and the oil passage 18 to the lower chamber 11*a* of the tilt cylinder 11 and also to the lower chambers 12*a* of the respective trim cylinders 12. The piston rods 11*c*, 12*c* are now pushed upwardly.

At the same time, working oil in the upper chamber 11*b* of the tilt cylinder 11 is delivered through the oil passage 22, the check valve 23, and the righthand pressure chamber 14*b* of the main valve 14 into the port 13*b* of the pump 13. The working oil delivered to the pump 13 is fed again from the port 13*a* to the lower chambers 11*a*, 12*a*. Working oil in the upper chambers 12*b* of the respective trim cylinders 12 are drained into the tank 17 through the oil passage 21. At the same time, working oil is drawn from the tank 17 through the oil passage 28 into the pump 13 to make up for an oil shortage that is caused by the portions of the piston rods 11*c*, 12*c* which are displaced out of the tilt and trim cylinders 11, 12. An excessive pressure buildup in the lower chambers 11*a*, 12*a* opens the up-blow valve 15, releasing working oil into the tank 17.

When the outboard engine is tilted upwardly, it may be locked against downward movement by locking the piston rod 11*c* that has projected upwardly.

With the piston rod 11*c* unlocked, the tilting and trimming mechanism operates to move the outboard engine downwardly as follows: As shown in FIG. 3, the pump 13 is reversed, i.e. , rotated in the opposite direction, to supply the working oil from the lefthand pressure chamber 14*a* to the righthand pressure chamber 14*b* of the main valve 14. The oil pressure applied to the righthand pressure chamber 14*b* opens the check valve 23, and also moves the spool 32 in the main valve 14 to the left, opening the check valve 19. The working oil is supplied through the check valve 23 and the oil passage 22 to the upper chamber 11*b* of the tilt cylinder 11, thus moving the piston rod 11*c* downwardly. Therefore, the volume of the lower chamber 11*a* is reduced. At this time, since the upper chambers 12*b* of the trim cylinders 12 are connected to the tank 17 and are not supplied with the working oil from the pump 13, the piston rods 12*c* are now lowered because the flow of fluid in the oil passage 18 to the chamber 14*a* reduces the pressure in the chambers 12*a*. The trim cylinders are thus prevented from being lowered prior to the tilt cylinder 11. Excessive working oil produced by a portion of the piston rod 11*c* which is introduced into the tilt cylinder 11 and forced from the lower chamber 11*a* is allowed to return to the tank 17 through the down-blow valve 16.

If the piston rod 11*c* remains locked in its upwardly projected position, then even when the pump 13 is reversed to discharge working oil from the port 13*b*, no working oil is supplied to the upper chamber 11*b* of the tilt cylinder 11. Therefore, the working oil discharged from the port 13*b* flows to the tank 17 through the down-blow valve 16. Since the piston rod 11*c* is locked against downward movement, the working oil is not drawn from the lower chamber 11*a* to the pump 13, thus developing a negative pressure in the oil passage 18. Consequently, the working oil in the lower chambers 12*a* is forcibly drawn to the pump 13, so that the piston rods 12*c* are moved downwardly. At this time, the suction-prevention valve 31 prevents working oil from being introduced from the tank 17 to the pump 13 under the negative pressure developed in the oil passage 18.

Accordingly, when the pump 13 is reversed while the piston rod 11*c* is locked against downward movement, the piston rods 12*c* of the trim cylinders 12 are automatically lowered without manual intervention. Inasmuch as the trim cylinders 12 can be contracted automatically by reversing the pump 13, no tedious and time-consuming manual work is necessary to withdraw the piston rods 12*c* as when the motorboat is moored.

Figure 4:
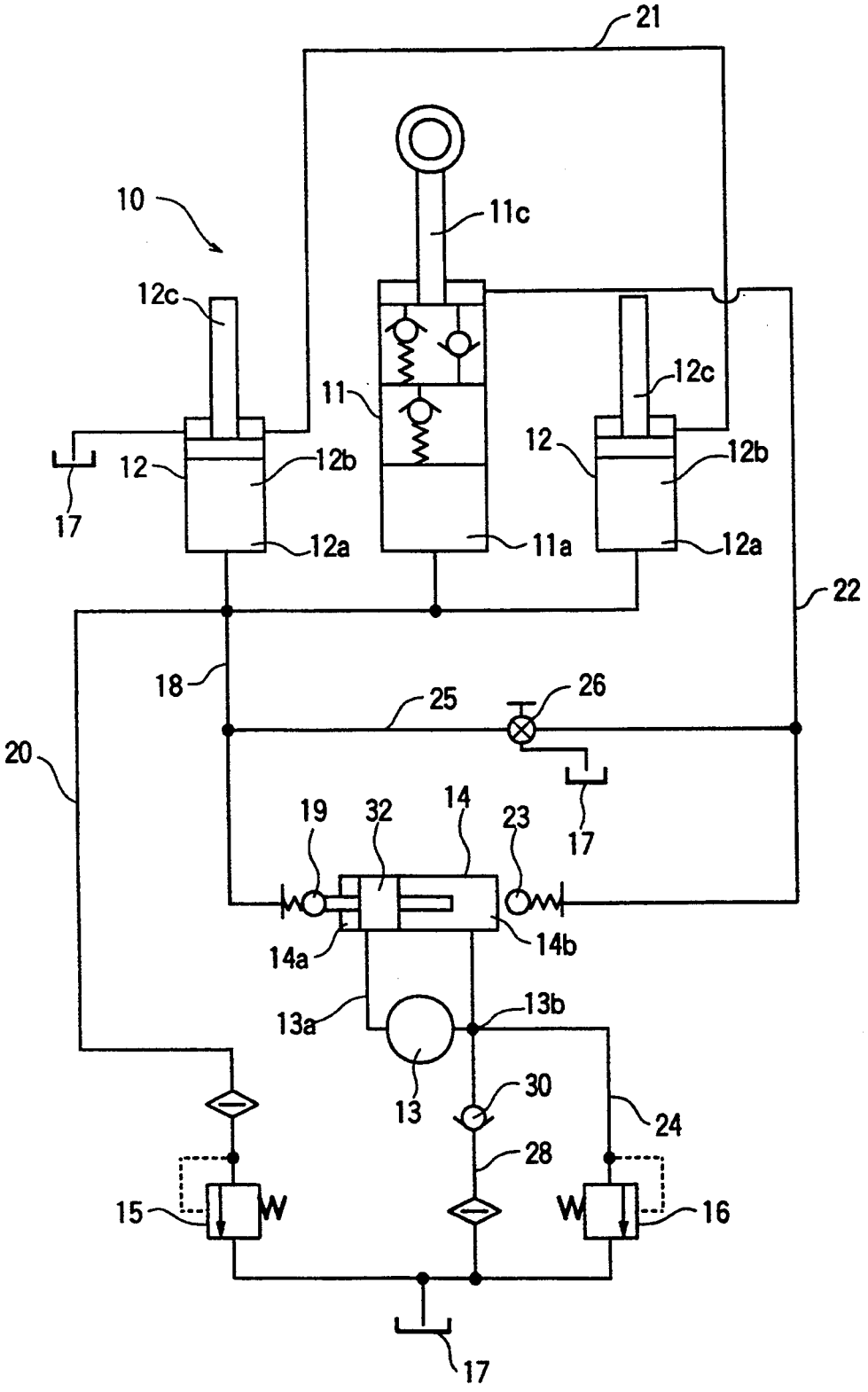
FIG. 4 is a circuit diagram of a hydraulic circuit arrangement of a tilting and trimming mechanism according to another embodiment of the present invention, showing parts positions when it tilts the outboard engine downwardly.

FIG. 4 shows a hydraulic circuit arrangement of a tilting and trimming mechanism according to another embodiment of the present invention. In FIG. 4, no oil passage is connected from the tank 17 to the port 13*a* of the pump 13. With the tilting and trimming mechanism shown in FIG. 4, if the piston rod 11*c* is locked against downward movement, a negative pressure developed in the oil passage 18 when the pump 13 is reversed forcibly draws the working oil from the lower chambers 12*a* to the pump 13, lowering the piston rods 12*c*. At this time, no working oil flows from the tank 17 to the port 13*a* of the pump 13.

In the hydraulic circuit arrangements shown in FIGS. 2 through 4, if the pump 13 is actuated after the outboard engine 5 is fully lowered by the tilt and trim cylinders 11, 12, i.e. , after all the working oil is discharged from the lower chambers 11*a*, 12*a* of the tilt and trim cylinders 11, 12, then cavitation is likely to occur in the oil passage 18. To avoid such cavitation, it is necessary to stop the pump 13 based on a sensor signal which is generated exactly when the downward movement of the outboard engine 5 with the tilt and trim cylinders 11, 12 is completed. Alternatively, working oil should be introduced from the tank 17 into the pump 13 if the pump 13 is actuated after the outboard engine 5 is fully lowered by the tilt and trim cylinders 11, 12.

Figure 5:
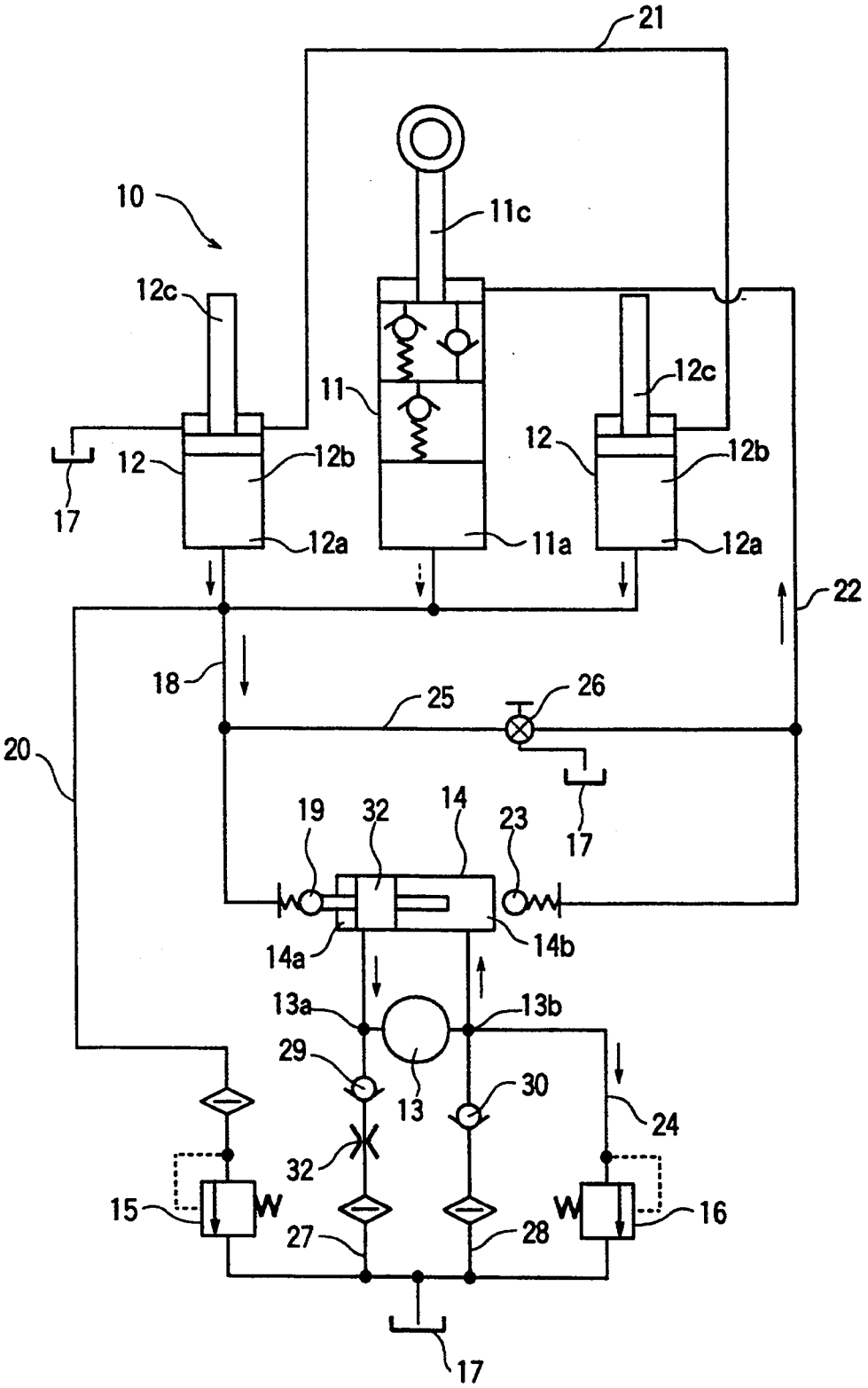
FIG. 5 is a circuit diagram of a hydraulic circuit arrangement of a tilting and trimming mechanism according to still another embodiment of the present invention, showing parts positions when it tilts the outboard engine downwardly.

FIG. 5 shows a hydraulic circuit arrangement of a tilting and trimming mechanism according to still another embodiment of the present invention. In this embodiment, an orifice 32 having a larger resistance to oil flow than the oil passage 18 is disposed in place of the suction-prevention valve 31 (FIGS. 2 and 3) in the oil passage 27 which interconnects the tank 17 and the pump port 13*a*. If the pump 13 is actuated after the outboard engine 5 is fully lowered by the tilt and trim cylinders 11, 12, then working oil is drawn from the tank 17 through the oil passage 27 to the pump 13 under the suction developed in the oil passage 18.

Figure 6:
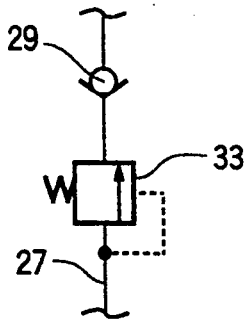
FIG. 6 is a circuit diagram of a modification of the tilting and trimming mechanism shown in FIG. 5.
Figure 7:
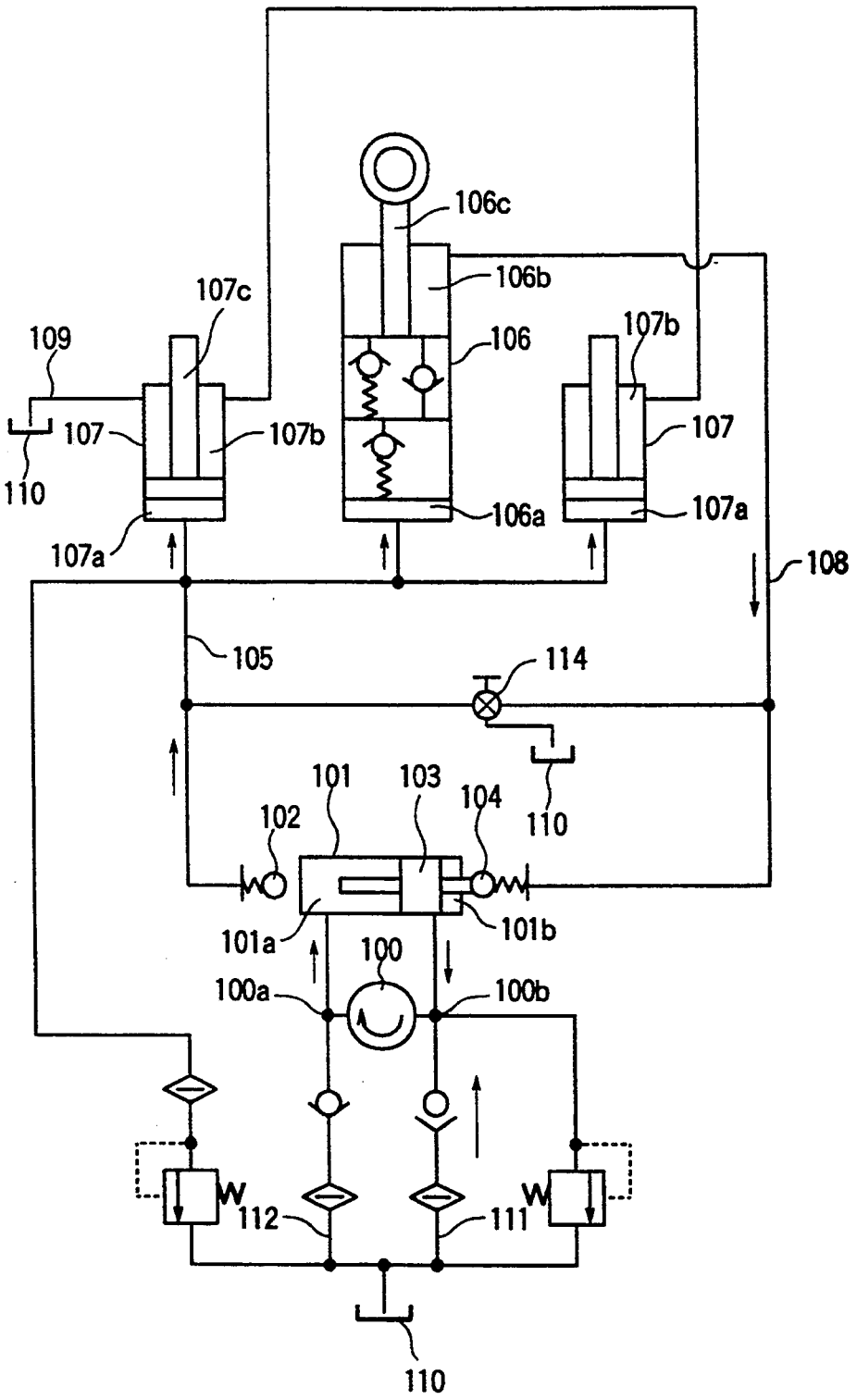
FIG. 7 PRIOR ART
FIG. 7 is a circuit diagram of a hydraulic circuit arrangement of a conventional tilting and trimming mechanism, showing parts positions when it tilts the outboard engine upwardly.
Figure 8:
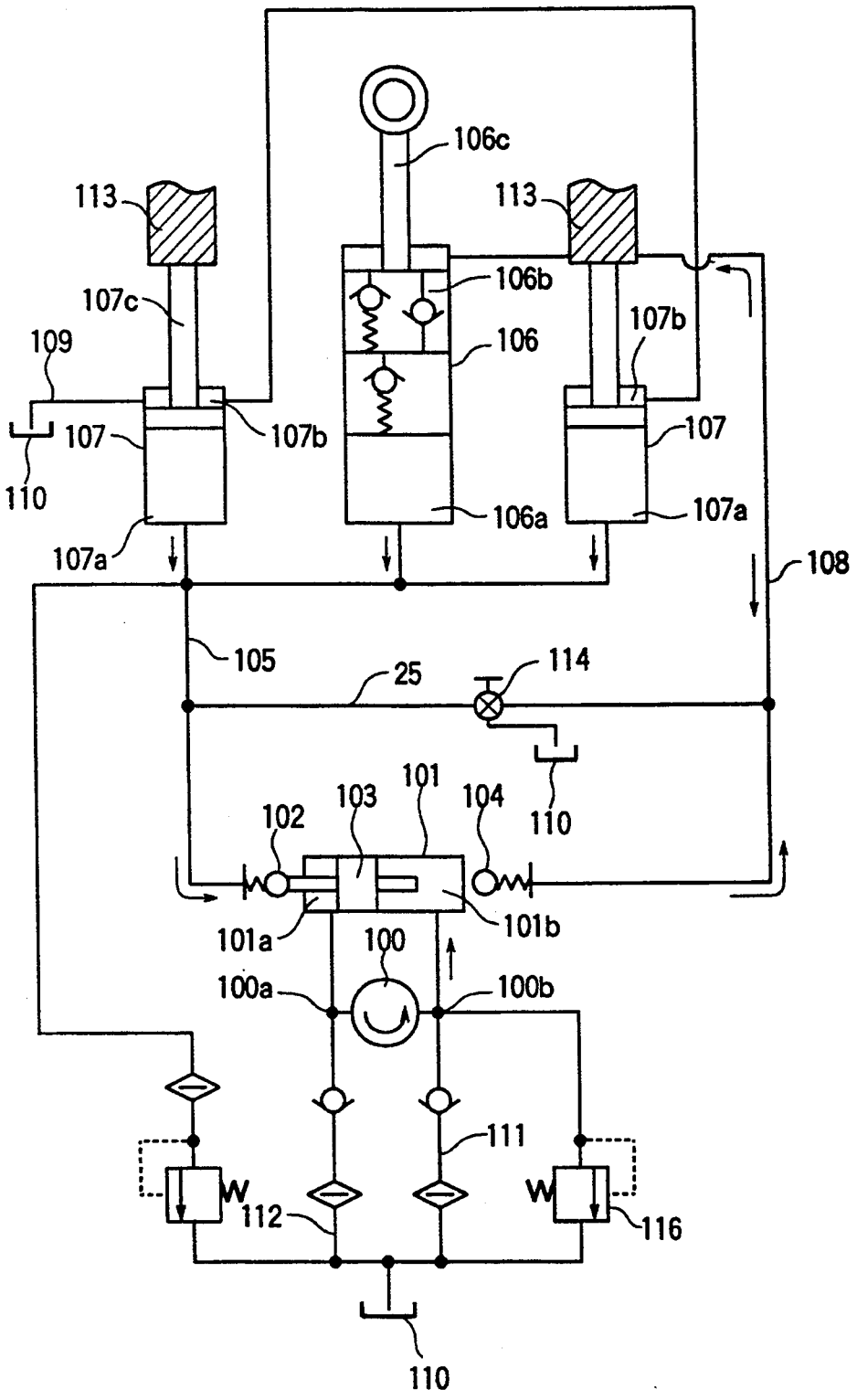
FIG. 8 PRIOR ART
FIG. 8 is a circuit diagram of a hydraulic circuit arrangement of the conventional tilting and trimming mechanism, showing parts positions when it tilts the outboard engine downwardly.

As shown in FIG. 6, the orifice 32 shown in FIG. 5 may be replaced with a pressure relief valve 33 which can be opened when it is subjected to a pressure greater than the resistance of the oil passage 18 to oil flow.

Although there have been described what are at present considered to be the prefer red embodiments of the invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. A mechanism for hydraulically tilting and trimming an outboard engine mounted on a water craft, comprising an oil tank;

a reversible pump having first and second parts, a tilt cylinder having a rod adapted to be coupled to an outboard engine, said tilt cylinder having a rod-end chamber and a blind-end chamber defined by a piston disposed in said chamber, at least one trim cylinder having a rod adapted to be coupled to an outboard engine, said at least one trim cylinder having a rod-end chamber and a blind-end chamber defined by a piston, a main valve, and said chambers, valve, tank and pump being interconnected such that said rod and piston of said trim cylinder are automatically located and maintained in said cylinder to place an engine at zero degrees trim relative to the longitudinal centerline of a draft when said rod of said tilt cylinder is locked in an engine out of the water position and said pump is rotated in a direction to move an engine in the water.

2. A mechanism for hydraulically tilting and trimming an outboard engine mounted on a boat, comprising:

an oil tank;

a reversible pump having a first port and a second port;

a tilt cylinder including a rod adapted to be coupled to said outboard engine for raising and lowering said outboard engine, said tilt cylinder further including a rod-end chamber and a blind-end chamber;

a trim cylinder including at least rod means for engaging and changing the angle of said outboard engine relative to the longitudinal centerline of the boat, said trim cylinder further including a rod-end chamber and a blind-end chamber;

a main valve;

locking means for locking said rod of said tilt cylinder in its upwardly projected position with said outboard engine out of the water; and a first oil passage connecting said blind-end chambers of said tilt and trim cylinders through said main valve to said first port of said reversible pump;

a second oil passage connecting rod-end chamber of said tilt cylinder through said main valve to said second port of said reversible pump;

a third oil passage connecting said rod-end chamber of said trim cylinder to said oil tank; and means for at least connecting said second port of said reversible pump to said oil tank and, upon said engine being locked out of the water by said locking means and said reversible pump being actuated in one direction so as to develop a negative pressure in the first oil passage, retracting said rod means of said trim cylinder by drawing the working oil from said blind-end chamber of said trim cylinder to said second port of said reversible pump.

3. A mechanism according to claim 2, wherein said means including a fourth oil passage connecting said first port of said reversible pump to said oil tank, said fourth oil passage having therein at least a pressure restricting mechanism capable of preventing an oil flow therethrough from said oil tank to said reversible pump under said negative pressure developed in said first oil passage.

4. A mechanism for hydraulically tilting and trimming an outboard engine mounted on a boat, comprising an oil tank;

a reversible pump having a first port and a second port, a tilt cylinder having a rod adapted to be coupled to an outboard engine for raising and lowering the engine out and in the water;

a main valve;

said tilt cylinder having a rod end chamber and a blind end chamber;

trim cylinder means having at least one rod means connected to said engine for changing the horizon orientation of the engine in the water;

said trim cylinder means having a rod end chamber and a blind end chamber;

means for locking said rod of said tilt cylinder with the engine out of the water to prevent lowering of the engine into the water; and means including said main valve for retracting said rod means of said trim cylinder upon said engine being locked out of the water by said means for hocking and by positively withdrawing working fluid from said blind-end chambers of said trim cylinders.

5. A mechanism according to claim 4 further comprising said main valve being positioned to drain fluid from said blind end of said trim cylinder means upon directing fluid under pressure to said rod end of said tilt cylinder when in the locked state.

6. A mechanism according to claim 4, wherein said pressure restricting mechanism comprises a suction-prevention valve.

7. A mechanism according to claim 4, wherein said pressure restricting mechanism comprises an orifice.

8. A mechanism according to claim 4, wherein said pressure restricting mechanism comprises a pressure relief valve.

9. The method of automatically retracting trim control rods of an outboard engine for small water craft when a tilt control mechanism has its control rod locked in the engine out of water positions, the trim control rods and the tilt operating mechanism controlled by a hydraulic system including a hydraulic pump, a control valve having a piston and cylinders with pistons for operating the control rods, the cylinders having rod end chambers and blind end chambers, said method comprising, locking the tilt control rod in the engine out of water position, applying fluid under pressure to attempt to lower the engine into the water, creating a back pressure to move the piston of the main valve to a position that drains the blind end chamber of the trim cylinders whereby the trim rods are retracted.

* * * * *